US010996597B2

(12) United States Patent
Tsukamoto

(10) Patent No.: US 10,996,597 B2
(45) Date of Patent: May 4, 2021

(54) BELT OFFSET CORRECTION DEVICE, FIXING DEVICE, AND IMAGE FORMING APPARATUS

(71) Applicant: SHARP KABUSHIKI KAISHA, Sakai (JP)

(72) Inventor: Kimihide Tsukamoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/597,436

(22) Filed: Oct. 9, 2019

(65) Prior Publication Data

US 2020/0117129 A1 Apr. 16, 2020

(30) Foreign Application Priority Data

Oct. 11, 2018 (JP) ..... JP2018-192909

(51) Int. Cl.
*G03G 15/20* (2006.01)
*G03G 15/00* (2006.01)
*G03G 15/16* (2006.01)

(52) U.S. Cl.
CPC ..... *G03G 15/2032* (2013.01); *G03G 15/755* (2013.01); *G03G 15/1615* (2013.01); *G03G 2215/00143* (2013.01); *G03G 2215/00413* (2013.01); *G03G 2215/2009* (2013.01)

(58) Field of Classification Search
CPC ..... G03G 15/2032; G03G 15/755; G03G 15/1615; G03G 2215/00143; G03G 15/2064; G03G 2215/00156; G03G 2215/2038; B65G 39/16
USPC ..... 198/807; 399/122, 313, 329
See application file for complete search history.

(56) References Cited

U.S. PATENT DOCUMENTS 8,099,034 B2 * 1/2012 Tsukamoto ..... G03G 15/2032 399/328
8,160,466 B2 * 4/2012 Yamanaka ..... G03G 15/2032 399/67
8,170,435 B2 * 5/2012 Ueno ..... G03G 15/2064 399/67
8,733,542 B2 5/2014 Yamaoka
9,170,536 B2 * 10/2015 Yoshikawa ..... G03G 15/2064
10,303,092 B2 * 5/2019 Nakano ..... G03G 15/2028

FOREIGN PATENT DOCUMENTS

JP 2012-198293 A 10/2012

* cited by examiner

*Primary Examiner* — Arlene Heredia
(74) *Attorney, Agent, or Firm* — ScienBiziP, P.C.

(57) ABSTRACT

A pair of pressure members are disposed at both ends of a pressure roller and rotatably support the pressure roller to press the pressure roller against a fixing roller including an elastic layer via a fixing belt. One of the pressure members that includes a fulcrum engaging section engaged with a rotation fulcrum at one end and is locked to a biasing member at a side opposite to the fulcrum engaging section is moved by a moving member in a direction intersecting a pressing direction of the pressure roller in a state where deformation of the elastic layer is regulated. Thus, a force acting on a fixing nip formed by the deformation of the elastic layer of the fixing roller is stabilized. As a result, the traveling performance of the fixing belt is stabilized, whereby the offset control can be performed with high accuracy.

9 Claims, 18 Drawing Sheets

STATE IN WHICH PRESSURE ROLLER IS SEPARATED

STATE IN WHICH PRESSURE ROLLER IS IN LINE CONTACT

STATE IN WHICH PRESSURE ROLLER IS PRESSED

STATE IN WHICH PRESSURE ROLLER IS SEPARATED

BELT OFFSET CORRECTION DEVICE, FIXING DEVICE, AND IMAGE FORMING APPARATUS

BACKGROUND OF THE INVENTION

Field of the Invention

The present invention relates to a belt offset correction device, a fixing device provided with the belt offset correction device, and image forming apparatuses such as a copying machine, a multi-function peripheral equipment, a printer, and facsimile equipment.

Description of the Background Art

Endless belts wound around a plurality of belt rollers are often offset in the width direction perpendicular to the circumferential direction of the belts due to the variations in components, or the like. For this reason, conventionally there have been proposed correcting devices that correct the belts' offsets. For example, Japanese Patent Application Laid-Open No. 2012-198293 discloses a configuration that in order to correct offsets of endless belts that are stretched and rotationally driven by a plurality of rollers, at least one of the plurality of rollers stretching the endless belts is tilted (see paragraph [0034], and FIG. 4 and FIG. 5 of Japanese Patent Application Laid-Open No. 2012-198293).

However, the configurations of the members that correct the belts' offsets are complicated because at least one of the plurality of rollers stretching the endless belts is tilted in the configuration described in Japanese Patent Application Laid-Open No. 2012-198293, which could cause upsizing of the device.

In order to solve this problem, the inventors of the present application focused on a pressure roller that presses an endless belt from the outside, and has already proposed a belt offset correction device that can achieve a simplified configuration and be reduced in size by having its pressure roller movably shifted.

The inventors of the present application found that further improvement of the pressure conditions for movably shifting the pressure roller and the movably-shifting direction of the pressure roller is necessary to obtain higher practicality of the belt offset correction device. Then, they found a specific configuration capable of movably shifting the pressure roller in a direction in which appropriate pressure conditions can be maintained.

SUMMARY OF THE INVENTION

The invention has been made in view of the above problems, and provides a configuration capable of improving the practicality of a belt offset correction device.

In order to achieve such a configuration, the invention provides the following belt offset correction device and image forming apparatus.

(1) Belt Offset Correction Device

The belt offset correction device according to one aspect of the invention is for correcting an offset of an endless belt, and the device includes an endless belt, a pressure roller that presses an outer side of the endless belt, an opposing member that is disposed inside the endless belt and sandwiches the endless belt with the pressure roller, a pair of pressure members that are disposed at both ends of the pressure roller to rotatably support the pressure roller and press the pressure roller against the opposing member, each of the pressure members including a fulcrum engaging section to be engaged with a rotation fulcrum at one end while being locked to a biasing member at a side opposite to the fulcrum engaging section, and a moving member that moves one of the pair of the pressure members in a direction intersecting a pressing direction of the pressure roller. At least one of the pressure roller and the opposing member includes an elastic layer. The moving member moves the pressure member in a state where deformation of the elastic layer is regulated.

(2) Fixing Device

A fixing device according to one aspect of the invention includes the belt offset correction device in which the endless belt is a fixing belt and the opposing member is a fixing roller.

(3) Image Forming Apparatus

An image forming apparatus according to one aspect of the invention includes a fixing device provided with the belt offset correction device in which the endless belt is a fixing belt and the opposing member is a fixing roller.

A pair of pressure members 110*a*, 110*b* are disposed at both ends of a pressure roller 172 and rotatably support the pressure roller 172 to press the pressure roller 172 against a fixing roller 171 including an elastic layer 171*c* via a fixing belt 173, where each of the pressure members 110*a*, 110*b* includes a fulcrum engaging section 110*e* to be engaged with a rotation fulcrum 113 at one end while being locked to a biasing member at a side opposite to the fulcrum engaging section 110*e* one of the pair of the pressure members is moved by moving members 140, 141 in a direction intersecting a pressing direction of the pressure roller 172 in a state where deformation of the elastic layer 171*c* is regulated.

With this configuration, the force acting on a fixing nip N formed by the deformation of the elastic layer 171*c* of the fixing roller 171 is stabilized. As a result, the traveling performance of the fixing belt 173 is stabilized, whereby the offset control can be performed with high accuracy.

DESCRIPTION OF THE PREFERRED EMBODIMENTS

Figure 1:
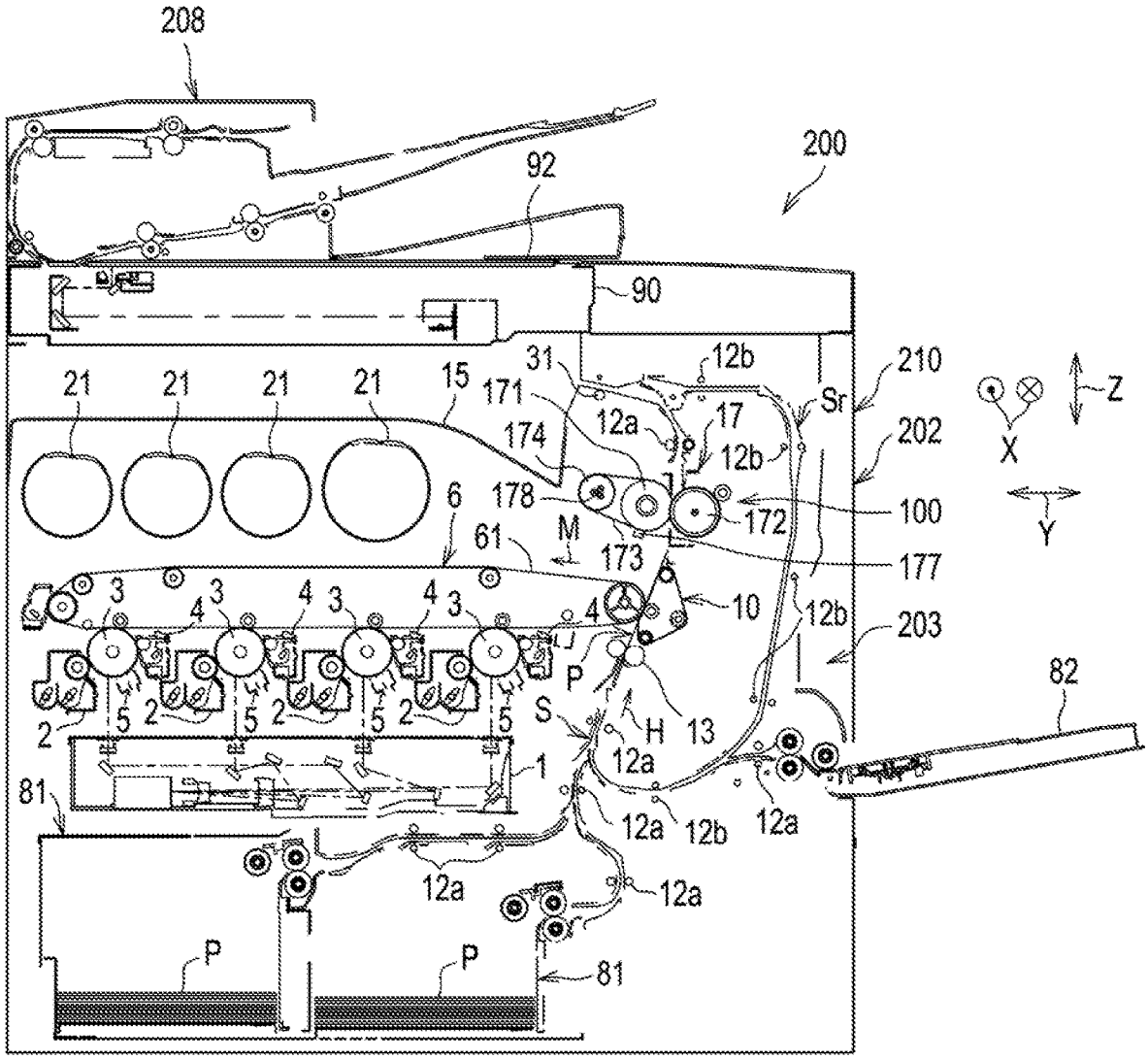
FIG. 1 is a schematic cross-sectional view of an image forming apparatus provided with a belt offset correction device according to an embodiment of the present invention as viewed from the front.

Hereinafter, exemplified embodiments of the invention will be described with reference to the drawings, in which the same components are denoted by the same reference numerals, and the names and functions thereof are also the same. The detailed descriptions thereof will not be repeated.

Overall Configuration of Image Forming Apparatus

FIG. 1 is a schematic cross-sectional view of an image forming apparatus 200 provided with a belt offset correction device 300 according to an embodiment of the invention as viewed from the front. In FIG. 1, the symbol X indicates a depth direction. The symbol Y indicates a right-left direction perpendicular to the width direction X, and the symbol Z indicates an up-down direction. The same is applicable to the drawings of FIG. 2 to FIG. 14.

The image forming apparatus 200 shown in FIG. 1 is a color image forming apparatus that forms multi color or single color images on sheets P such as recording paper in an electrophotographic method based on image data read by an image reader 90 or image data transmitted from outside. Note that the image forming apparatus 200 may be a monochrome image forming apparatus. The image forming apparatus 200 also may be another type of color image forming apparatus.

The image forming apparatus 200 includes a document feeder 208 and an image forming apparatus main body 210. The image forming apparatus main body 210 includes an image former 202 and a sheet conveying system 203.

The image former 202 includes an exposure device 1 (specifically, an exposure unit of a writing optical system), a plurality of developing devices 2 to 2 (specifically, development units), a plurality of photoreceptor drums 3 to 3, a plurality of photoreceptor cleaners 4 to 4, a plurality of chargers 5 to 5, a primary transfer belt device 6, a plurality of toner cartridge devices 21 to 21 (specifically, toner cartridge units), and a fixing device 17 (specifically, a fixing unit). In addition, the sheet conveying system 203 includes a paper feed tray 81, a manual paper feed tray 82 in which envelopes and the like are set, and a discharge tray 15.

The image forming apparatus main body 210 includes a document placement table 92 in its upper portion, which is made of a transparent glass on which documents (not shown) are to be placed, and includes the image reader 90 under the document placement table 92, which reads images on the documents. The document feeder 208 is provided above the document placement table 92. The image of the document read by the image reader 90 is transmitted as image data to the image forming apparatus main body 210, and an image formed based on the image data in the image forming apparatus main body 210 are recorded on the sheets P.

The image data handled in the image forming apparatus 200 corresponds to a color image to be formed using a plurality of colors (black (K), cyan (C), magenta (M), and yellow (Y) in the present embodiment). Thus, the plurality of developing devices 2 to 2, the plurality of photoreceptor drums 3 to 3, the plurality of photoreceptor cleaners 4 to 4, the plurality of chargers 5 to 5, the plurality of toner cartridge devices 21 to 21 (four for each member, corresponding respectively to black, cyan, magenta, and yellow in the present embodiment) are provided in order to form plural kinds (four kinds in the present embodiment) of images corresponding to the plurality of colors, and these members constitute a plurality of (four in the present embodiment) image forming stations.

When image formation is performed in the image forming apparatus 200, a printed material such as a sheet P (hereinafter, referred to as the sheet P) is fed from the paper feed tray 81 or the manual paper feed tray 82 to be conveyed up to a resist roller 13 by conveyance rollers 12*a* to 12*a* provided along a sheet conveyance path S. Then, the sheet P is conveyed by a secondary transfer belt device 10 according to a timing at which the sheet P is matched with a toner image on a primary transfer belt 61 that is moved in a circumferential direction M in the primary transfer belt device 6, and the toner image is transferred onto the sheet P. Then, the sheet P is passed between the fixing roller 171 and the pressure roller 172 in the fixing device 17, whereby unfixed toner on the sheet P is melted by heat to be fixed thereto, and discharged onto the discharge tray 15 via the conveyance rollers 12*a* and a discharging roller 31. In addition, when image formation is performed not only on the front surface of the sheet P but also on the back surface in the image forming apparatus 200, the sheet P is conveyed in a reverse direction from the discharging roller 31 to a revere path Sr to be reversed via a conveyance roller 12*b* and guided back to the resist roller 13. Similarly to the image formation on the front surface of the sheet P, a toner image is fixed on the back surface of sheet P and discharged onto the discharge tray 15. In this manner, the image forming apparatus 200 completes a series of printing operations.

It is also possible to form a monochrome image using at least one of the four image forming stations and transfer the monochrome image to the primary transfer belt 61 of the primary transfer belt device 6. Similarly to the color images, the monochrome image is also transferred from the primary transfer belt 61 to the sheet P and fixed on the sheet P.

Fixing Device

First Embodiment

Next, an example will be described, in which the belt offset correction device 300 according to the present embodiment is applied to a fixing device 17 of a belt fixing type.

Basic Configuration of Fixing Device

Figure 2:
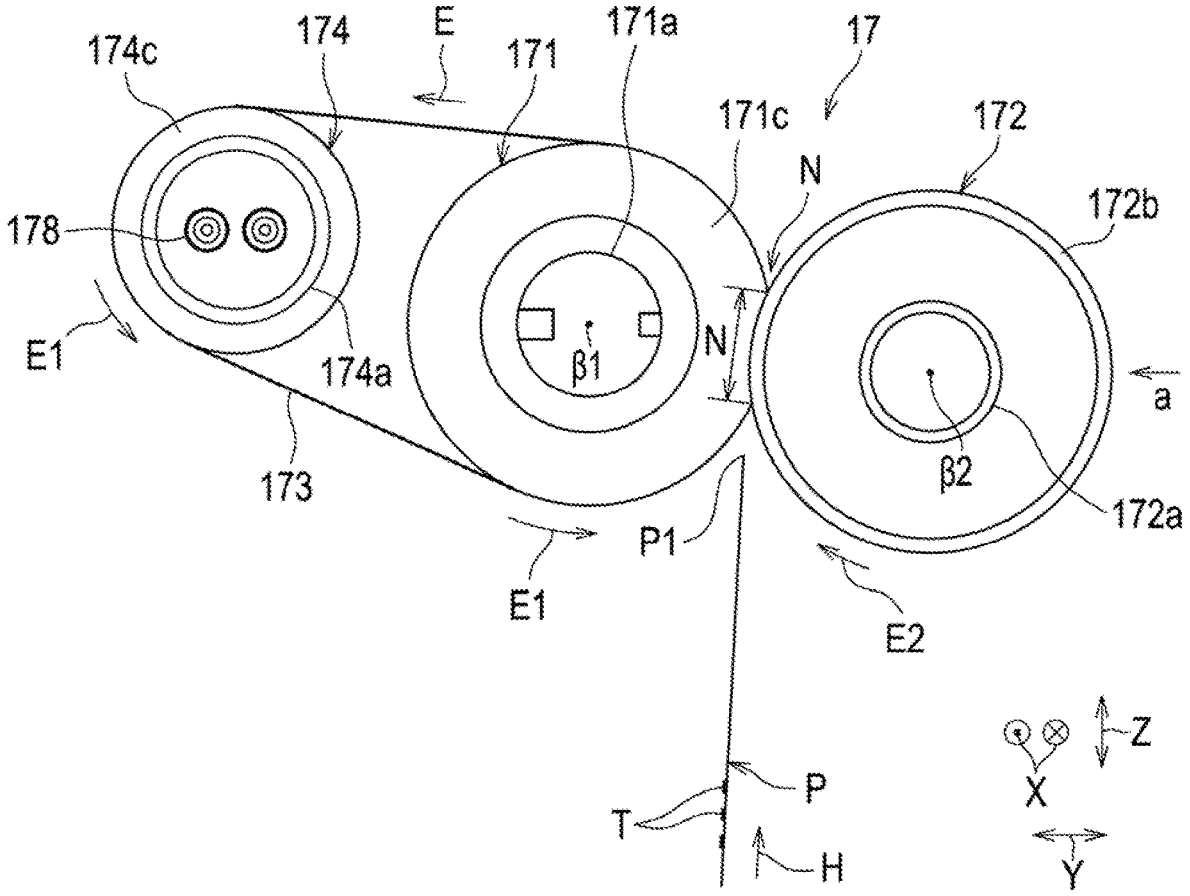
FIG. 2 is a front view showing a schematic configuration of a fixing device according to the first embodiment.
Figure 3:
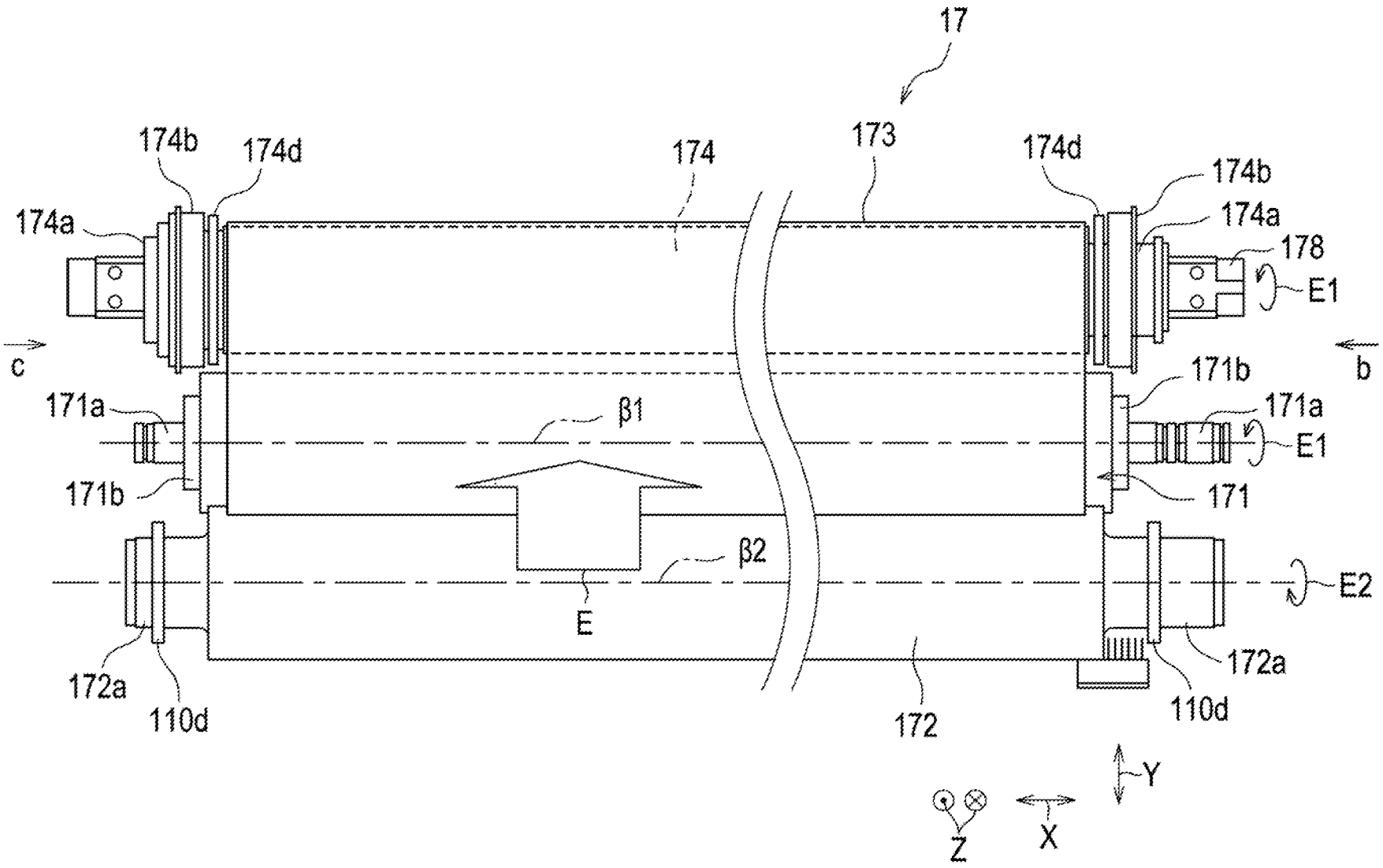
FIG. 3 is a plan view showing a schematic configuration of the fixing device according to the first embodiment.
Figure 4A:
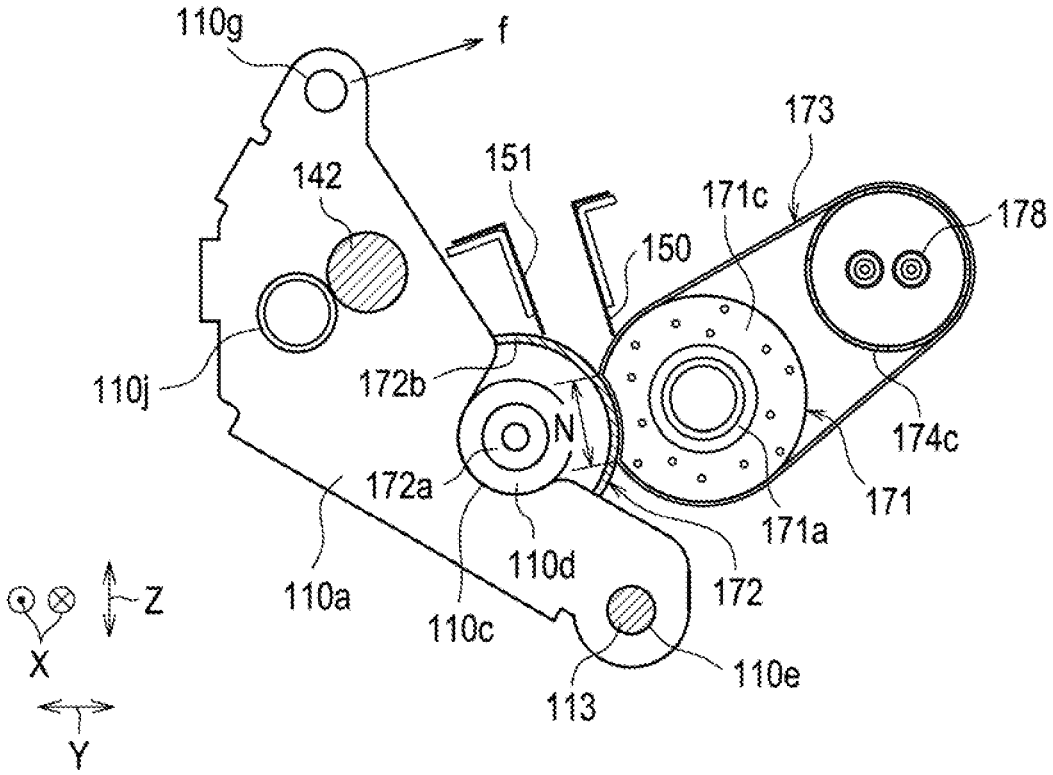
FIG. 4A is a rear view showing a pressure mechanism of the fixing device according to the first embodiment.
Figure 4B:
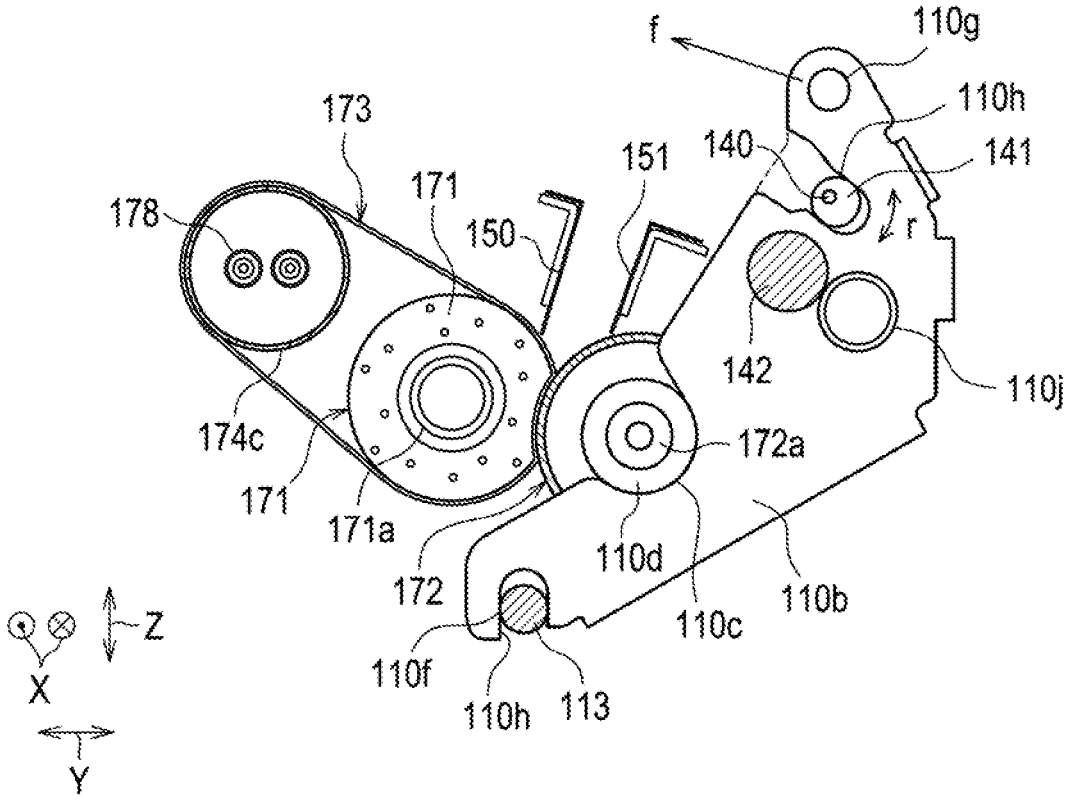
FIG. 4B is a front view showing a pressure mechanism of the fixing device according to the first embodiment.
Figure 5:
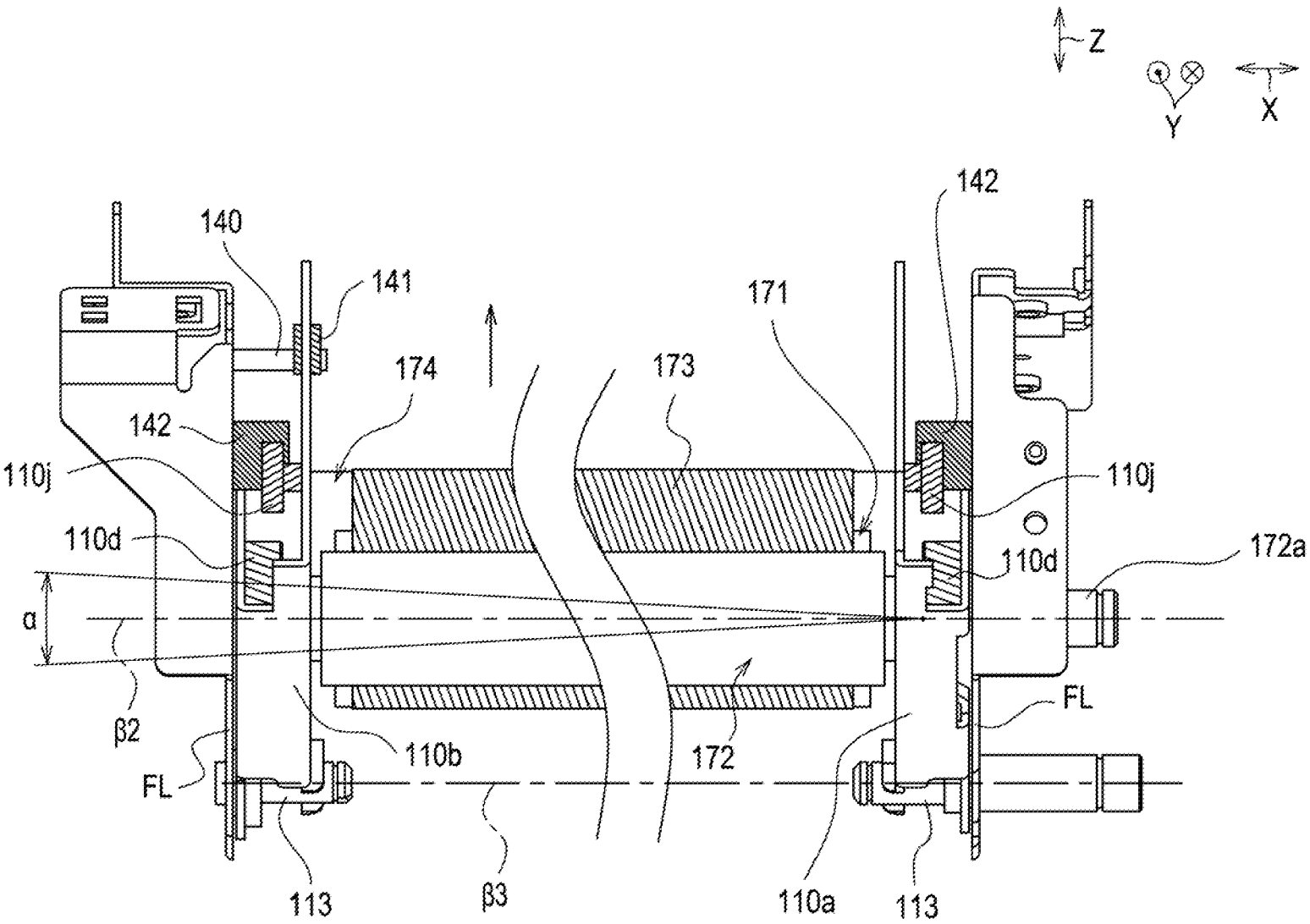
FIG. 5 is a view illustrating the control range of a pressure roller position.

FIGS. 2 and 3 are a front view and a plan view showing a schematic configuration of the fixing device 17. FIG. 4A is a view of the fixing device 17 as viewed from the arrow b in FIG. 3, that is, as viewed from the rear side in the depth direction. FIG. 4B is a view of the fixing device 17 as viewed from the arrow c in FIG. 3, that is, as viewed from the front side in the depth direction. FIG. 5 is a view of the fixing device 17 as viewed from the arrow a in FIG. 2, that is, as viewed from the right side in the width direction of the apparatus. The fixing device 17 includes a plurality of belt rollers (the fixing roller 171 and the heating roller 174 in the present embodiment), an endless belt (the fixing belt 173 in the present embodiment) wound around the plurality of belt rollers, and the pressure roller 172 that sandwiches the fixing belt 173 with the fixing roller 171 therebetween and rotates together with the fixing belt 173. A contact portion N between the fixing belt 173 and the pressure roller 172 is called a fixing nip, and the sheet P is sandwiched at this portion while being conveyed.

A heat source 178 is provided inside the heating roller 174, and the heating roller 174 is heated by receiving heat from the heat source 178. The fixing belt 173 receives heat from the heated heating roller 174 and heated to reaches a predetermined temperature. The fixing belt 173 heated to the predetermined temperature is sent to the fixing nip N, where a toner image formed on the sheet P is fixed to the sheet P with heat and pressure. The fixing belt 173 is maintained at a predetermined fixing temperature on the basis of a signal from a temperature detector 177 (specifically, a temperature sensor such as a thermistor).

The fixing roller 171 has an elastic layer 171*c* made of an elastic material such as silicon rubber on its surface, and the rotation shafts 171*a*, 171*a* are provided rotatable to the frame of the fixing device 17 (specifically, a fixing frame FL) via bearings 171*b*, 171*b* (see FIG. 3). The elastic layer 171*c* may be formed like a porous sponge. An upper tearing-off member 150 that tears off the sheet P from the fixing roller 171 is disposed downstream of the fixing roller 171.

The pressure roller 172 includes an elastic layer 172*b* made of a rubber member such as silicon rubber, and has its rotation shafts 172*a*, 172*a* supported rotatable by a pressure lever 110*a* and a pressure lever 110*b* via bearings 110*d*, 110*d*. The pressure lever 110*a* includes a bearing supporter 110*c* that is engaged with the bearing nod that is on the rear side in the depth direction x of the pressure roller 172 and supports the bearing 110*d*, an engaging section 110*e* disposed at one end and engaged with a rotation spindle 113 provided to the fixing frame FL, and a locking section 110*g* disposed at an end on the side opposite to the engaging section 110*e* and locked to the biasing member. The pressure lever 110*b* includes a bearing supporter 110*c* that supports a bearing 110*d* that is on the front side in the depth direction of the pressure roller 172, an engaging section 110*f* disposed at one end and engaged with the rotation spindle 113 provided to the fixing frame FL, and a locking section 110*g* disposed at an end on the side opposite to the engaging section 110*f* and locked to the biasing member.

The rotation spindles 113 are disposed so that their central axis ß3 is parallel to a rotation axis line ß1 of the fixing roller. The pressure lever 110*a* and the pressure lever 110*b* enforce and press the pressure roller 172 toward the fixing roller 171 using forces of biasing members (not shown) attached to the locking sections 110*g*. Here, the ends of the biasing members opposite to the locking sections 110*g* are locked to the locking sections of the fixing frame FL, whereby a predetermined biasing force acts on the pressure roller 172. Note that a lower tearing-off member 151 that tears off the sheet P from the pressure roller 172 is disposed downstream of the pressure roller 172.

The fixing belt 173 is made by providing an elastic layer (not shown) made of a rubber member such as silicone rubber on a base member (not shown) made of an engineering resin such as polyimide or metal such as nickel. The fixing belt 173 may include a release layer provided on a surface of an engineering resin such as polyimide and polycarbonate.

While the heating roller 174 has a configuration that its rotation shafts 174*a* are provided rotatable to the frame of the fixing device 17 (specifically, the main body frame FL) via bearings 174*b*, it is also possible that the bearings 174*b* are supported being enforced and movable by a biasing member or the like (e.g., a coil spring) that provides a biasing force to the side opposite to the fixing roller 171, whereby the fixing belt 173 is provided with given tension. The heating roller 174 includes a body 174*c* that suspends the fixing belt 173 between the rotation shaft 174*a* and the rotation shaft 174*a* (in the center portion). A metal tube member that allows the rotation shafts 174*a* to be same in outer diameter as the body 174*c* may be used as the heating roller 174. A roller member 174*d* that protects and guides the edges of the fixing belt 173 may be provided between the body 174*c* and the bearings 174*b*.

The fixing device 17 includes an operating mechanism. As will be described later, the operating mechanism acts as means for conducting pressure welding, pressure regulation, and press-contact release of the pressure roller 172 on the fixing roller 171, and also acts as means for correcting offsets of the fixing belt 173 by movably-shifting of the pressure roller 172. Note that the operating mechanism will be explained in detail later.

As to the above-described fixing device 17 which is mounted on the image forming apparatus main body 210, the rotational driving force from an operating mechanism (not shown) on the side of the image forming apparatus main body 210 is transmitted to the rotation shafts 171*a* of the fixing roller 171 via gears (not shown) to rotationally drive the fixing roller 1711 in a predetermined rotation direction E1 (see FIG. 2). Along with the rotation of the fixing roller 171, the fixing belt 173 is moved in a circumferential direction E that is the same circumferential direction as the rotation direction E1 of the fixing roller 171 to rotate the heating roller 174 in the rotation direction E1, and further the pressure roller 172 is dependently rotated in a direction E2 opposite to the rotation direction E1 of the fixing roller 171. Then, a sheet P on which an unfixed toner image T is formed and conveyed in a sheet conveying direction H is received, conveyed while being sandwiched between the fixing belt 173 and the pressure roller 172, and heated and pressurized at the fixing nip N. Note that the rotation shafts 172*a* of the pressure roller 172 may be driven by gears instead of the rotation shafts 171*a* of the fixing roller 171.

In addition, the fixing device 17 may include a tension roller disposed inside or outside of the fixing belt 173 and pressing the fixing belt 173 outward or inward so as to provide tension to the fixing belt 173. In addition, the fixing roller 171 and/or the pressure roller 172 may include a heat source 178. If a tension roller is provided, the tension roller may include a heat source 178. When the fixing belt 173 is further wound around other rollers, another heat source 178 may be provided to at least one of the other rollers.

Belt Offset Correction Principle and Issues

An offset correction method for the fixing belt 173 according to the first embodiment will be described.

Offset correction of the fixing belt 173 is performed by positively tilting the rotation axis line ß2 of the pressure roller 172 with respect to the rotation axis line ß1 of the fixing roller 171 as shown in FIG. 5. Indicated as $\alpha$ in FIG. 5 is an inclination range of the rotation axis line ß2 of the pressure roller 172, when taking the rotation axis line ß1 of the fixing roller 171 as the center. When the position of the bearing 110*d* that is on the front side in the depth direction x of the pressure roller 172 is moved in the width direction z while the position of the bearing 110*d* that is on the rear side in the depth direction x is fixed, the direction of the fixing belt 173 sent out from the fixing nip N (the direction indicated by the arrow in FIG. 5) varies, a detailed structure of which will be described later. Thus, the offsets of the fixing belt 173 can be corrected.

In particular, a large force acts on the fixing nip N in order to sufficiently fix the melted toner on the sheet material P, so that the offset correction of the fixing belt 173 can be performed effectively. However, since the force of the pressure roller 172 gripping the fixing belt 173 also becomes larger, if the direction of the force acting on the fixing nip N or the shape of the fixing nip N varies unstably, the direction of the fixing belt 173 sent out from the fixing nip N becomes unstable, that is, the traveling performance of the fixing belt 173 becomes unstable, which causes some problems in practicality in that offset control is difficult to perform with accuracy.

Nip Shape Stabilization Mechanism

Here, a shape stabilization mechanism of the fixing nip N according to the first embodiment will be described.

Figure 6A:
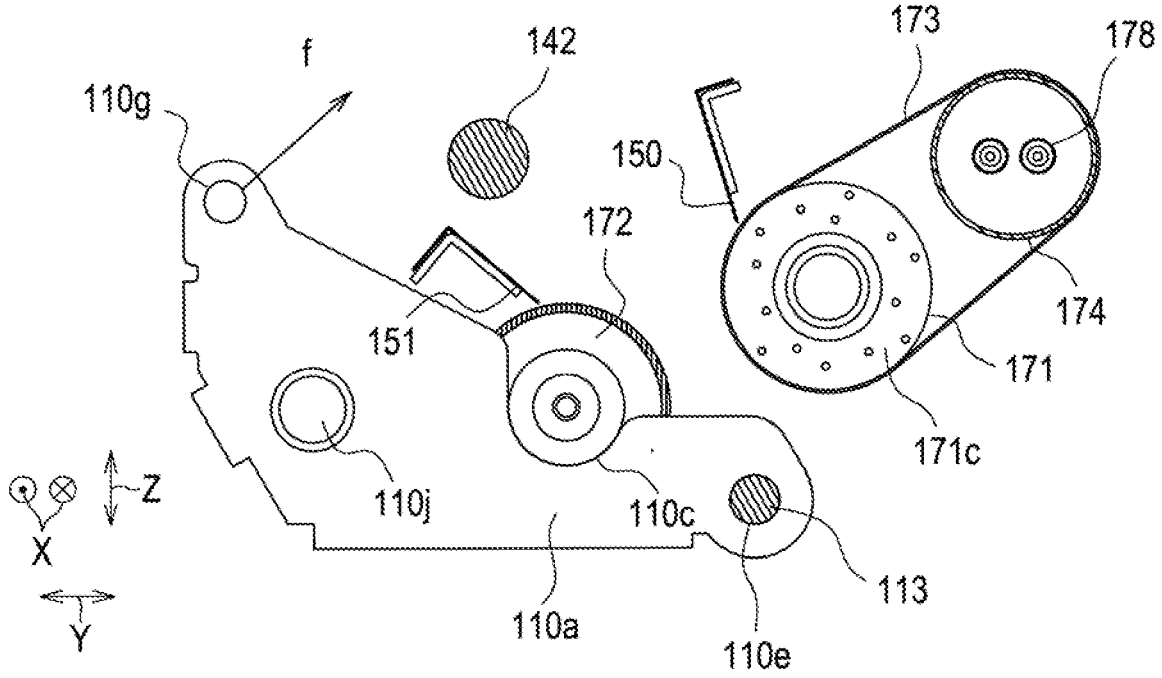
FIG. 6A is a schematic front view illustrating a separated state of a pressure roller.
Figure 6B:
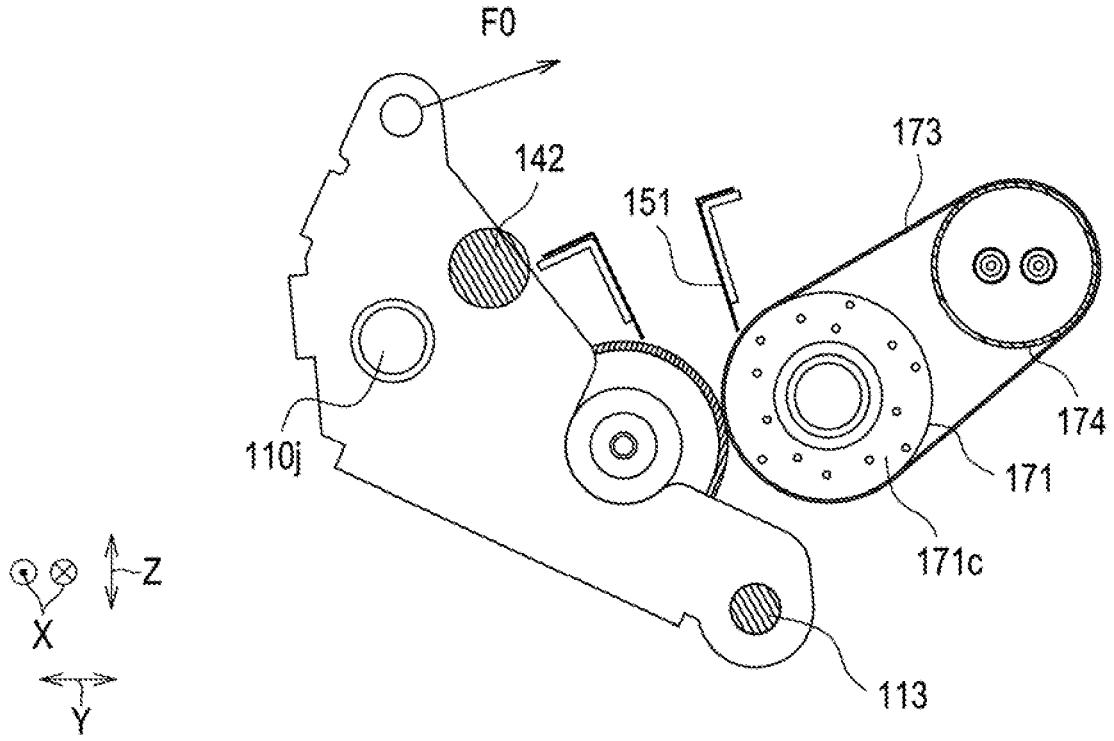
FIG. 6B is a schematic front view illustrating a state in which the pressure roller is in line contact with a transfer belt.
Figure 6C:
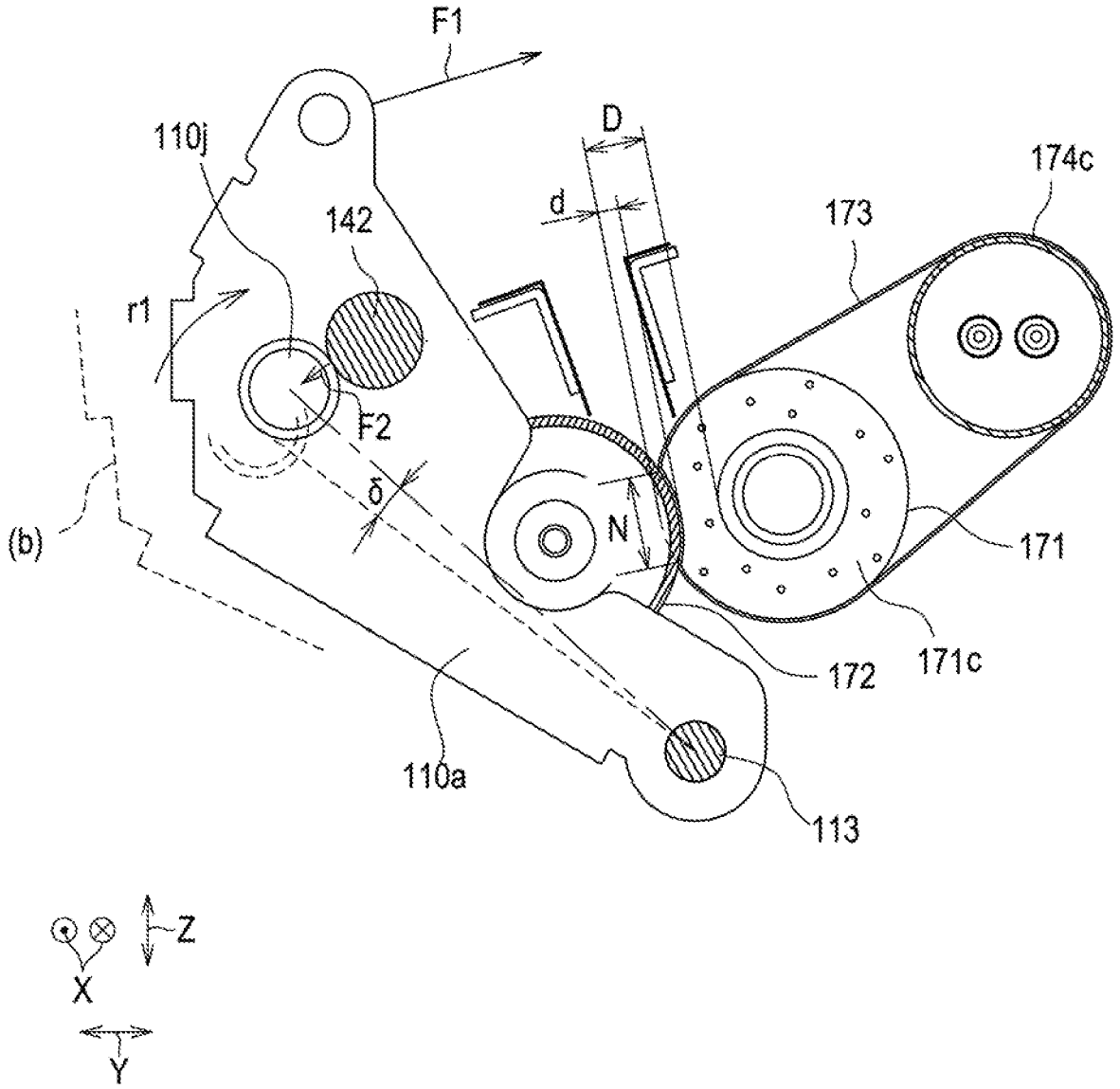
FIG. 6C is a schematic front view illustrating a state in which a fixing nip is formed in the pressure roller.

FIGS. 6A, 6B, and 6C are views showing the state variations from when the pressure lever 110*a* presses the pressure roller 172 against the fixing roller 171 until when the fixing nip N is formed.

FIG. 6A is a view showing a state in which the pressure roller 172 is separated from the fixing belt 173 on the fixing roller 171, where a movement restrictor 110*j* and the lower tearing-off member 151 are attached to the pressure lever 110*a*. In addition, a cylindrical stopper 142 is disposed at a predetermined position away from the rotation spindle 113. The rotation spindle 113 and the stopper 142 are disposed so as to have a predetermined positional relationship with the fixing frame FL.

FIG. 6B is a view showing a state in which the pressure roller 172 is in contact (line contact) with the fixing belt 173. In this state, the fixing nip N is linear and hardly presses the fixing roller 171.

FIG. 6C is a view showing a state in which a predetermined biasing force F1 is made to act on the locking section 110*g* of the pressure lever 110*a* by the biasing member, where the pressure roller 172 presses the fixing belt 173 against the fixing roller 171 to form the predetermined fixing nip N. At this time, the movement restrictor 110*j* of the pressure lever 110*a* is brought into contact with the stopper 142, and the pressure lever 110*a* thus cannot be rotated anymore; however, a force obtained by subtracting a reaction force F2 acting on the movement restrictor 110*j* from a force F1 acting on the locking section 110*g* acts on the fixing nip N. This force deforms the elastic layer 171*c* of the fixing roller 171 to form the fixing nip N. In other words, the pressure lever 110*a* starts to press the elastic layer 171*c* of the fixing roller 171 from the position shown in FIG. 6B, and while the pressure lever 110*a* rotates by δ from the position, the amount of deformation of the elastic layer 171*c* increases, whereby the fixing nip N is formed.

When rubber materials such as silicon rubber from which the elastic layer 171*c* is made are used under conditions where the deformation amount of the elastic layer 171*c* is large, the elastic properties tend to deteriorate at a faster rate. For stable use over a long period of time, the elastic layer 171*c* needs to be used within a range that the deformation amount does not exceed its pressure resistance. The deformation amount can be expressed as the ratio of the amount of compressive deformation d to the thickness D of the elastic layer 171*c*, that is, the compression ratio. The compression ratio of the elastic layer 171*c* is regulated to be a predetermined value or less, for example, 30% or less by bringing the movement restrictor 110*j* into contact with the stopper 142, which allows the shape and pressure of the fixing nip to be kept unchanged over a long period of time.

Pressure Roller Contact Position Moving Mechanism

Here, a contact position moving mechanism of the pressure roller 172 according to the first embodiment will be described.

Figure 7:
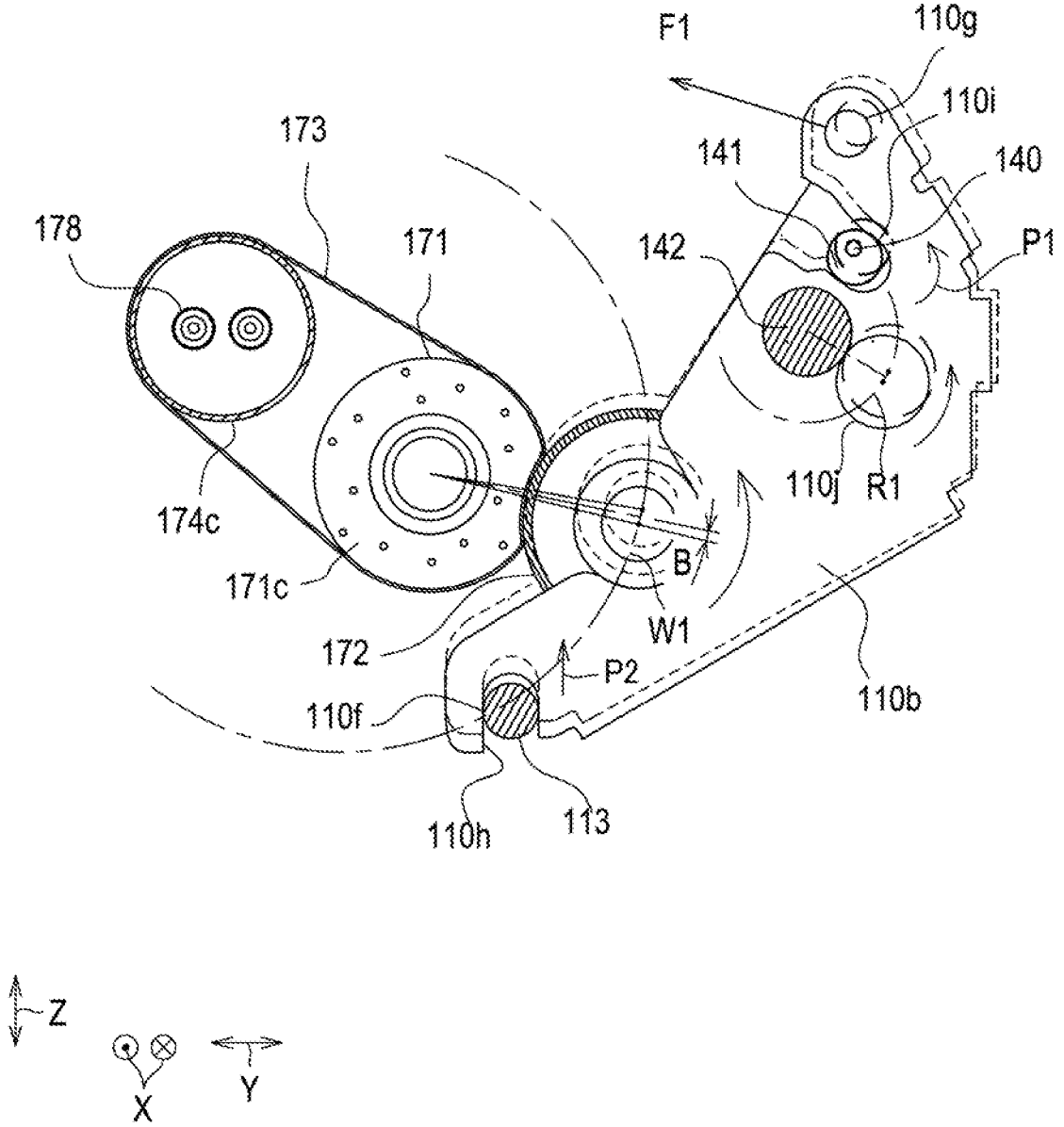
FIG. 7 is a schematic front view illustrating a relationship between a moving direction of a pressure lever and a moving direction of the pressure roller.

FIG. 7 is a view illustrating a mechanism for moving an end on one side of the pressure roller 172 in the circumferential direction of the fixing roller 171.

The pressure lever 110*b* shown in FIG. 7 supports the bearing 110*d* that supports the rotation shaft 172*a* on the front side in the x direction (depth direction) of the rotation shafts 172*a* of the pressure roller 172, and the fulcrum engaging section 110*f* includes a guide 110*h* that guides the pressure lever 172 so as to be movable with respect to the rotation fulcrum 113. The pressure lever 110*b* includes a cam contact member 110*i* that is brought into contact with the cam 141. The cam 141 is provided around a cam shaft 140, and rotating the cam shaft 140 with the use of a drive source shown) allows the position of the pressure lever 110*b* to be varied.

Next, a mechanism for varying the contact position of the pressure roller 172 will be described with reference to FIG. 7. FIG. 7 shows the state in which the pressure roller 172 has its end on the front side in the x direction (depth direction) located below the end on the rear side. When the cam shaft 140 rotates counterclockwise from this state, that is, rotates in a direction P1, a biasing force by the biasing member acts on the locking section 110*g* of the pressure lever 110*b*, which allows the movement restrictor 110*j* to move along in contact with the outer peripheral surface of the stopper 142. The movement restrictor 110*j* and the stopper 142 extend in a direction parallel to the rotation axis ß1 of the fixing roller 171, and have surfaces of a cylindrical shape, which allows the movement restrictor 110*j* to move along an arc-shaped line R1 around the stopper 142. At this time, the engaging section 110*f* engaged with the rotation fulcrum 113 is moved in a predetermined linear direction P2 by the guide 110*h*. To be specific, the movement restrictor 110*j* moves in an arc shape while the engaging section 110*f* moves linearly, whereby the pressure roller 172 is moved in an arc shape along the outer periphery of the fixing roller 171. As a result of this, the fixing belt 173 can be always pressed toward the center of the fixing roller 171 regardless of the position of the pressure roller 172, which can stabilize the feeding-out direction and amount of the belt from the fixing nip N. In other words, meandering correction can be performed while the traveling performance of the fixing belt 173 is stable. Note that B in FIG. 7 indicates the center position of the pressure roller 172 when the cam is in a neutral position.

Belt Offset Detection and Correction Control

Here, a description of a controller that detects offsets of the fixing belt 173 and corrects the offsets of the fixing belt 173 based on a detection result will be provided.

Figure 9:
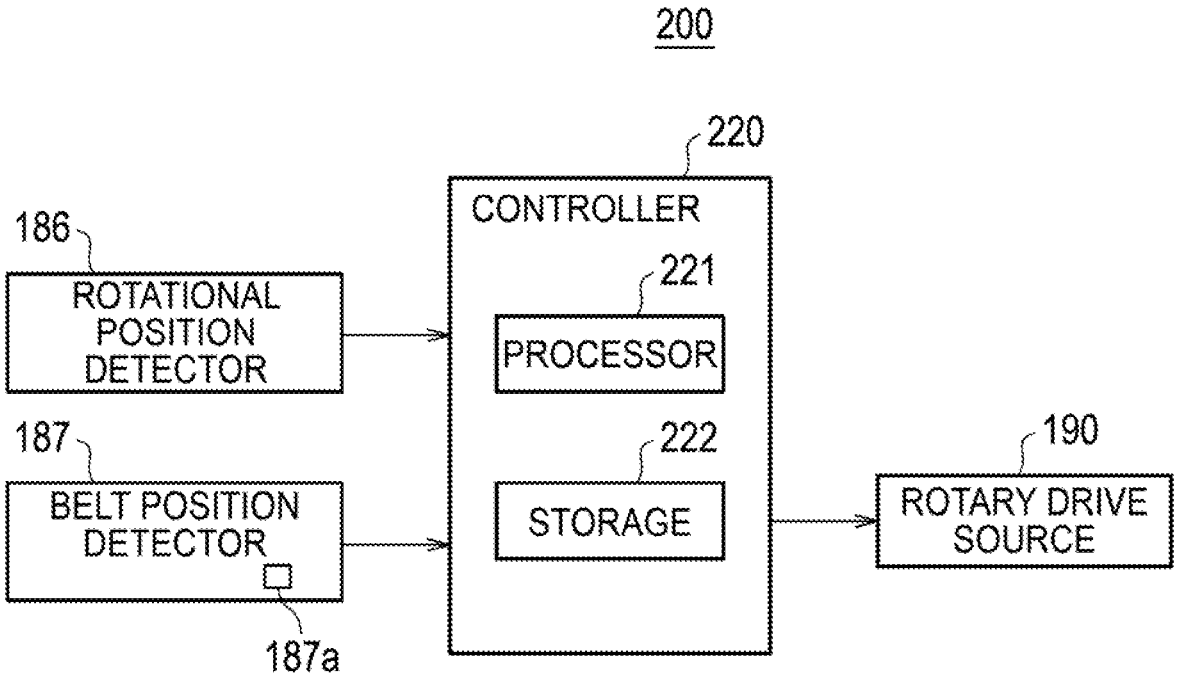
FIG. 9 is a view illustrating the configuration of a controller that performs correction control of belt's offsets.

FIG. 9 is a view illustrating the configuration of the controller that performs correction control of offsets of the fixing belt 173. The controller 220 obtains belt position signals from a belt position detector 187 at predetermined time intervals, and controls the rotation direction and rotation amount of the cam shaft 140 so that the inclination amount of the rotation axis ß2 of the pressure roller 172 with respect to the rotation axis ß1 of the fixing roller 171 varies every time the belt position detector 187 detects that the edge of the fixing belt 173 passes a predetermined position in the direction of the rotation axis ß1 of the fixing roller 171. In this manner, correction control of offsets of the fixing belt 173 can be performed. Note that the rotation direction and rotation amount of the cam shaft 140 can be obtained by storing as a reference value a time of the moment at which a detection-subject section provided at the edge of the cam shaft 140 passes a sensor in a storage 222, and making a calculation using a processor based on the rotational feeding amount of the cam shaft 140 from the time. It is also possible to determine the rotation direction and rotation amount of the cam shaft 140 by storing in a storage the time of the cam shaft 140 at which the detection-subject section passes a sensor and the rotational feeding amount of the cam shaft 140 from the time to the present, and making a calculation based on the result.

In addition, as shown in FIG. 9, the image forming apparatus 200 may further include a controller 220 that controls the entire image forming apparatus 200. The controller 220 may be provided to the fixing device 17 or the belt offset correction device 300. The controller 220 includes a processor 221 including a microcomputer such as a CPU (Central Processing Unit), and a storage 222 including a non-volatile memory such as a ROM (Read Only Memory) and a volatile memory such as a RAM (Random Access Memory). The controller 220 is designed to control the operation of each component by having the processor 221 load a control program stored in advance in the ROM of the storage 222 onto the RAM of the storage 222 and running the program.

Figure 8:
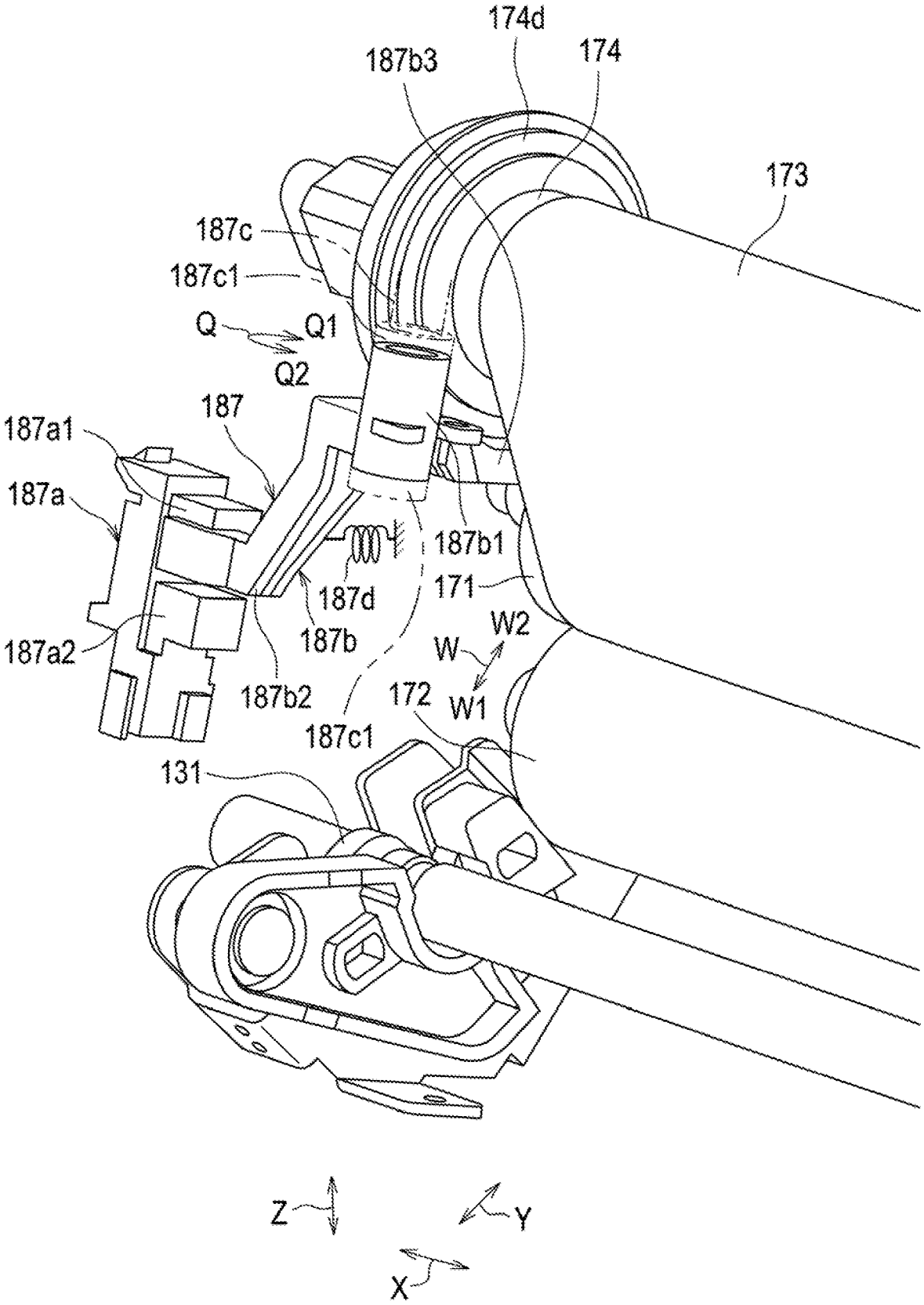
FIG. 8 is a view illustrating a detector that detects a fixing belt position.

FIG. 8 is a perspective view of an offset detector of the fixing belt 173 as seen from an oblique direction.

The single base-point detector 187 that detects a predetermined base point in the width direction X perpendicular to the circumferential direction E of the fixing belt 173 is provided outside on one side (on the front side in the present embodiment) in the width direction X of the fixing belt 173. In the present embodiment, the base-point detector 187 includes a transmissive photosensor 187*a* and a movable section 187*b* (specifically, an actuator). The transmissive photosensor 187*a* includes a light emitter 187*a*1 that emits light, and a light receiver 187*a*2 that receives light from the light-emitter 187*a*1. The movable section 187*b* is supported by a rotation shaft 187*c* so as to be rotatable in a rotation direction Q about the rotation shaft 187*c* between a light-transmitting position and a light-shielding position with respect to the transmissive photosensor 187*a*. The movable section 187*b* includes a main body 187*b*1 provided rotatable to the rotation shaft 187*c*, a detection-subject section 187*b*2 provided to the main body 187*b*1, and a contact portion 187*b*3 provided to the main body 187*b*1 at an angle different in the circumferential direction from the detection-subject section 187*b*2. The main body 187*b*1 is a cylindrical member, and its movement in the axial direction is restricted by a pair of restrictors 187*c*1, 187*c*1 provided to the rotation shaft 187*c*. The detection-subject section 187*b*2 is rotated in one direction Q1 or the other direction Q2 of the rotation direction Q, and takes, in the rotation direction Q, the light-shielding position at which light from the light emitter 187*a*1 to the light receiver 187*a*2 in the transmissive photosensor 187*a* is shielded, and the light-transmitting position at which light from the light emitter 187*a*1 to the light receiver 187*a*2 in the transmissive photosensor 187*a* is transmitted. The contact portion 187*b*3 is in contact with an edge on one side in the width direction X of the fixing belt 173 (the front side in the present embodiment). The movable portion 187*b* is forced by a biasing member 187*d* (specifically, a coil spring) in a direction (one direction Q1 in the present embodiment) in which the contact portion 187*b*3 is brought into contact with the fixing belt 173.

The base-point detector 187 (specifically, the transmissive photosensor 187*a*) is electrically connected to an input system of the controller 220. Thus, the light receiver 187*a*2 receives OFF signals or ON signals from the base-point detector 187 when the detection-subject section 187*b*2 is at the light-shielding position or the light-transmitting position, which allows the controller 220 to detect for (recognize) the presence or absence of the edge (one example of the base point) on one side of the fixing belt 173.

Effects of First Embodiment

Since the pressure levers 110*a* and 100*b* each include the movement restrictors 110*j* that come into contact with the stoppers 142, the deformation amount of the elastic layer 171*c* of the fixing roller 171 is regulated, which can stabilize the conditions of the pressure acting on the fixing nip N. As a result of this, the traveling performance of the fixing belt 173 is stabilized, whereby the offset control can be performed with high accuracy.

In addition, since the end on one side of the pressure roller 172 can be moved in an arc shape along the outer periphery of the fixing roller 171, the traveling performance of the belt during offset correction can be stabilized.

In other words, moving the pressure lever 110*b* in the direction intersecting the pressing direction of the pressure roller 172 in a state where the deformation amount of the elastic layer 171*c* of the fixing roller 171 is regulated allows meandering correction to be performed effectively.

Second Embodiment

A fixing device 18 according to the second embodiment is the same as the fixing device according to the first embodiment except that a sheet heating element such as a ceramic heater is used as a heat source, and thus a duplicate description is omitted.

Figure 10:
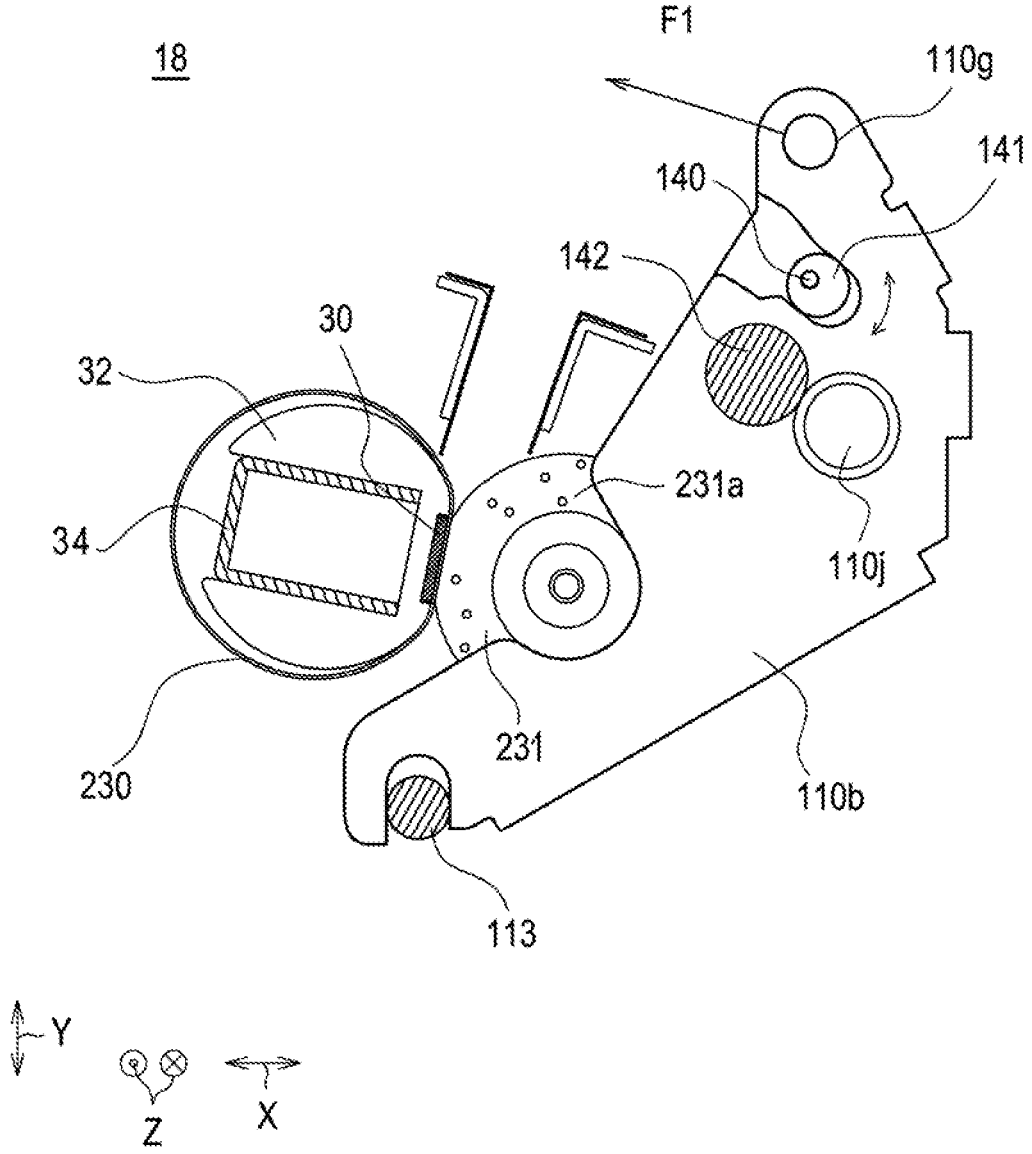
FIG. 10 is a front view showing a fixing device according to the second embodiment.

FIG. 10 is a front view of the fixing device 18. A fixing belt 230 is sandwiched not between a fixing roller and a pressure roller 231, but sandwiched between a sheet heating element 30 and a pressure roller 231, whereby a nip N is formed. The sheet heating element 30 is held by a guide member 32 and is reinforced by a reinforcing member 34 so that the guide member 32 does not warp even when pressed by the pressure roller 231.

The pressure roller 231 includes an elastic layer 231*a* in order to obtain an appropriate fixing nip N.

The moving mechanism of the pressure roller 231 is the same as the moving mechanism according to the first embodiment.

Effects of Second Embodiment

Even when the member (opposing member) that sandwiches the fixing belt 230 with the pressure roller 231 therebetween to form the fixing nip N is not of a roller shape, an end on one side of the pressure roller 231 can be moved in a state where the deformation of the elastic layer 231*a* of the pressure roller 231 is regulated, which allows the traveling performance of the fixing belt 230 during offset correction to be stabilized, whereby offsets of the fixing belt 230 can be corrected with high accuracy.

Third Embodiment

A fixing device 19 according to the third embodiment is different only in including second cams 132 that are disposed at positions opposed to the movement restrictors 110*j*, 110*j* of the pressure levers 110*a* and 110*b* on a rotation shaft 120 of a first cam 131 engaged with the guide 110*h* provided to the pressure lever 110*b*, and brought into contact with the movement restrictors 110*j*, 110*j* to restrict the deformation amount of the elastic layer 171*c* of the fixing roller 171, and in that the second cams 132 have such a shape as to change the distance between the axes of the fixing roller 171 and the pressure roller 172, and thus a duplicate description is omitted.

Figure 11:
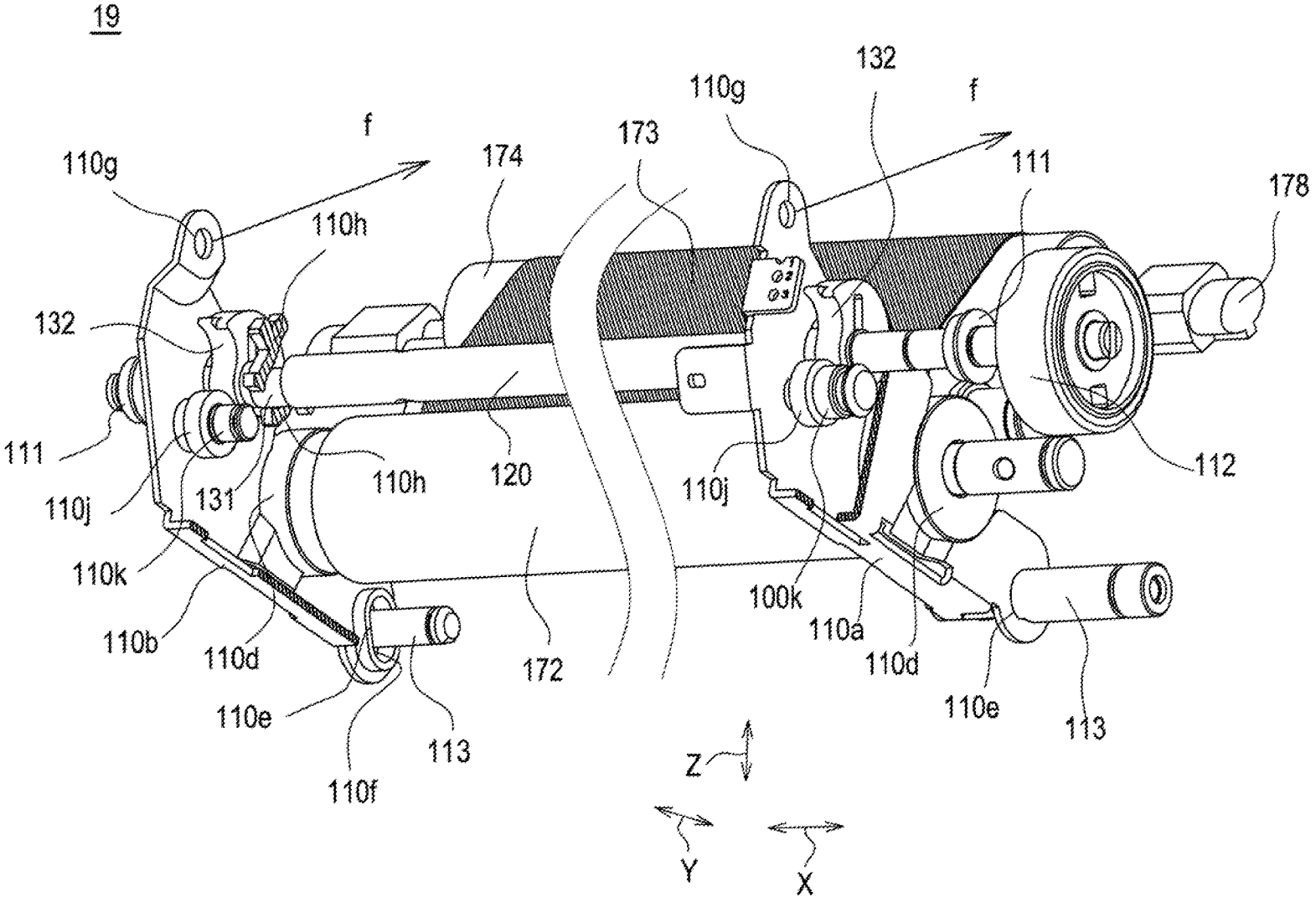
FIG. 11 is an oblique view showing a fixing device according to the third embodiment.
Figure 12:
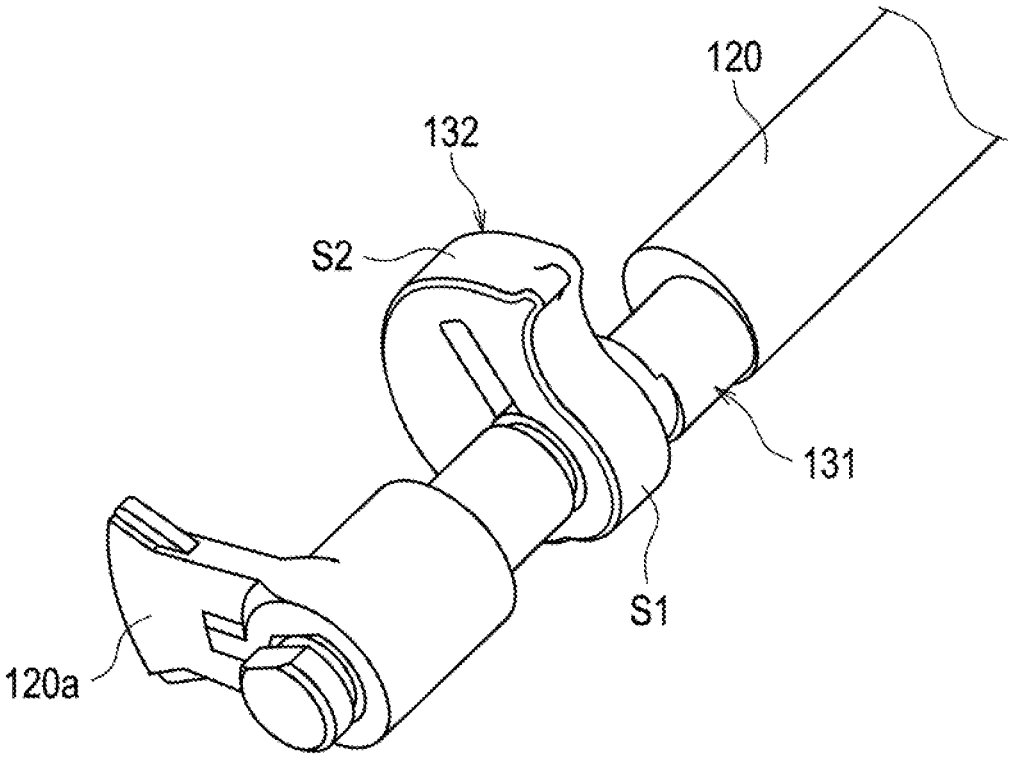
FIG. 12 is a view illustrating installation positions of a first cam and a second cam in the fixing device according to the third embodiment.
Figure 13A:
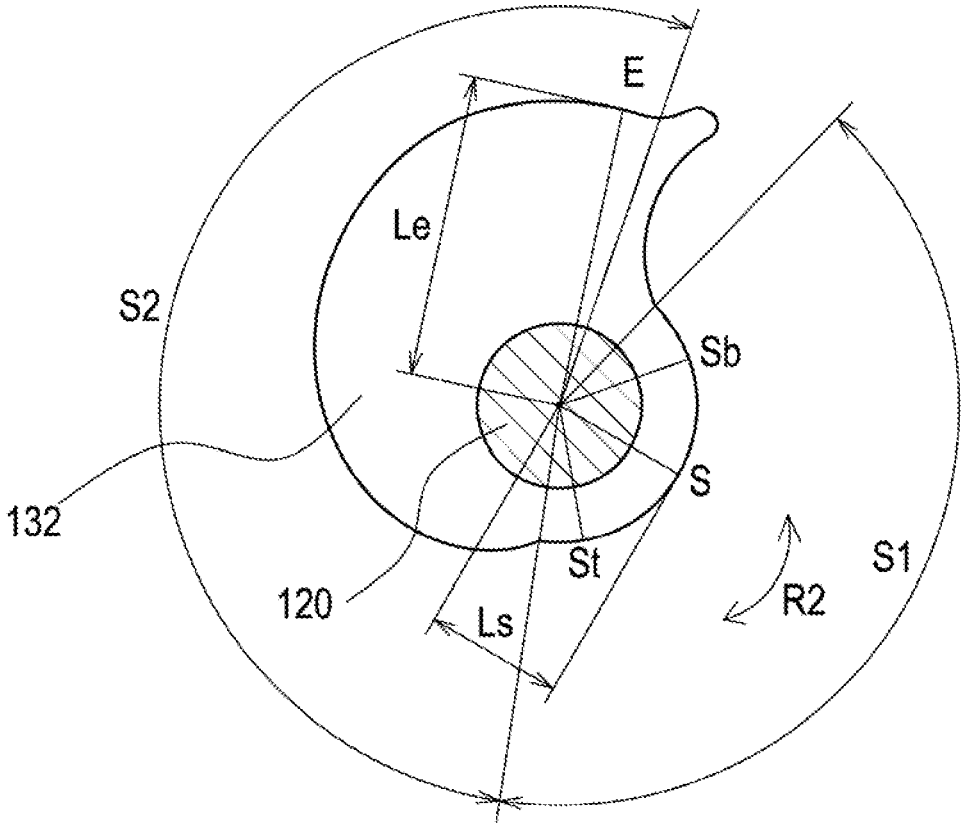
FIG. 13A is a view illustrating the shape of the second cam in the fixing device according to the third embodiment.

FIG. 11 is a perspective view of the fixing device 19 seen from an oblique direction, and also is a view a part of which is omitted for easy understanding of the structure. FIG. 12 is a view illustrating installation positions of the first cam 131 and the second cam 132. FIG. 13 is views illustrating the shape of the second cam 132. FIG. 14 is a view showing a state in which the pressure roller 172 is separated from the fixing roller 171 and the fixing belt 173 by the rotation of the second cam 132.

As shown in FIG. 11, the rotation shaft 120 including the first cam 131 that is engaged with the guide 110*h* of the pressure lever 110*b* includes the second cams 132 at its both ends that each come into contact with the movement restrictors 110*j*. The rotation shaft 120 also includes cam bearings 111 outside of the second cams 132, and the cam bearings 111 are supported rotatable by a fixing frame FL (not shown). In addition, the rotation shaft 120 includes a cam shaft rotation gear 112 at its one end. The first cam 131 and the second cams 132 are rotated by rotating the cam shaft rotation gear 112 with the use of a drive source disposed on an image forming apparatus side (not shown).

The movement restrictors 110*j* have an outer periphery of a cylindrical shape, and are supported rotatable by bosses 100*k* of the pressure levers 110*a* and 110*b*. Note that the movement restrictors 110*j* do not have to have an outer periphery of a cylindrical shape only if they have a predetermined continuous curved surface. In addition, the movement restrictors 110*j* do not have to be disposed rotatable.

Figure 13B:
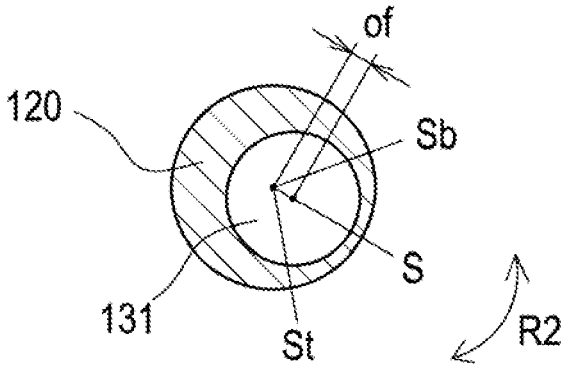
FIG. 13B is a view illustrating the shape of the first cam in the fixing device according to the third embodiment.
Figure 14:
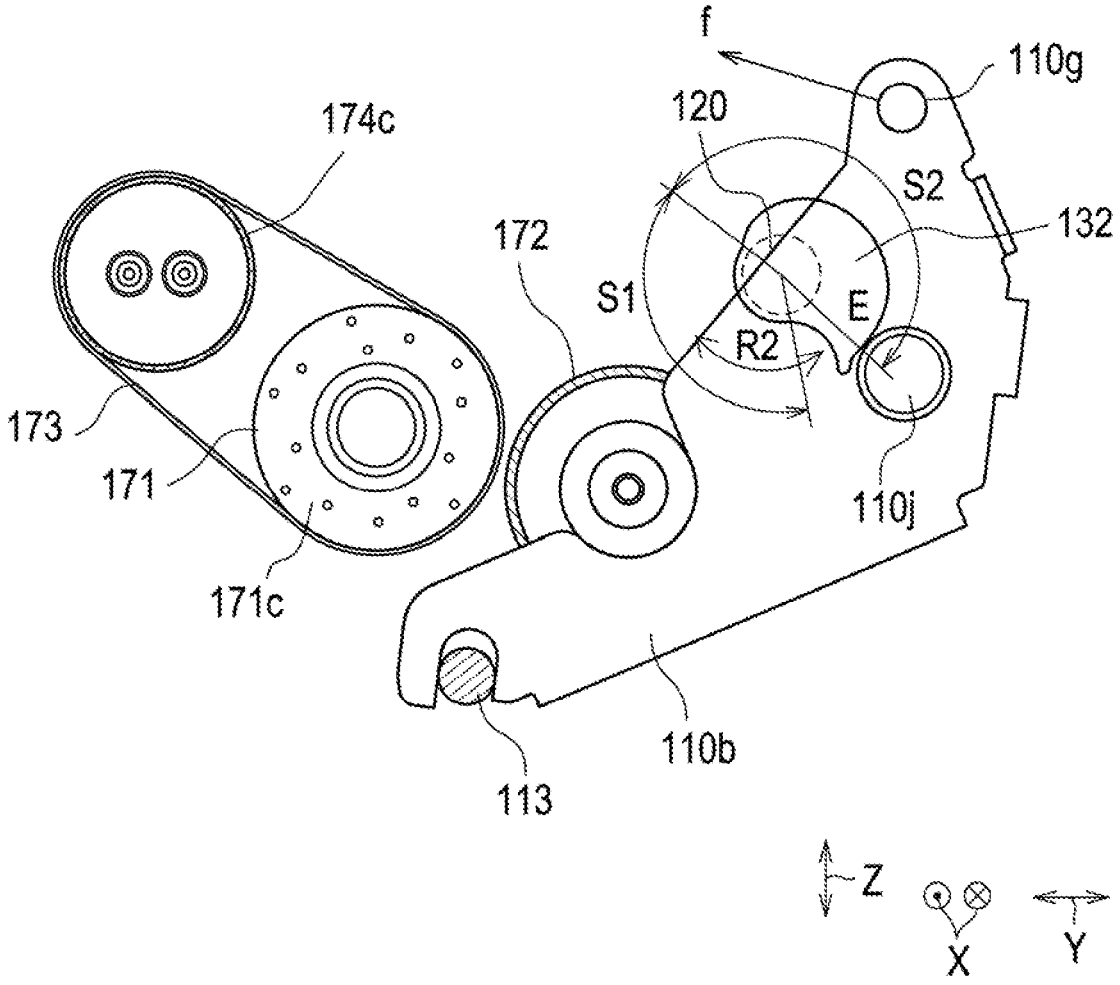
FIG. 14 is a view showing a state in which a pressure roller is separated by the second cam in the fixing device according to the third embodiment.

As can be seen from FIG. 13B, the first cam 131 has an eccentric cam shape formed by shaving the rotation shaft 120 to offset the center axis of the first cam 131 from the rotation axis of the rotation shaft 120 by "of".

The neutral position of the first cam 131 defines the position S shown in FIGS. 13A and 13B. By rotationally moving the rotation shaft 120 in a direction R2 between Sb and St with the use of a drive source (not shown), the position of the pressure lever 110*b* is moved. At this time, the contact position of the first cam 131 with the movement restrictor 110*j* is moved forming an arc shape between Sb and St shown in FIG. 13A by the biasing force acting on the locking sections 110*g* of the pressure levers 110*a* and 110*b*. At this time, because the distance from the center of the rotation shaft 120 is a constant value Ls in a range S1 (a deformation amount maintaining range) including Sb and St, the pressure roller 172 is moved forming a predetermined arc shape around the fixing roller 171 as described above.

In addition, the range S2 of each second cam 132 has a shape in which the distance from the center of the rotation shaft 120 gradually increases from Ls to Le (a moving-away range). Thus, when each second cam 132 is rotated in a counterclockwise direction with respect to the drawing, the movement restrictor 110*j* moves away from the rotation center of the rotation shaft 120 as shown in FIG. 14, and when the contact position of the movement restrictor 110*j* reaches E, the pressure roller 172 is separated from the surface of fixing belt 173.

Effects of Third Embodiment

By providing the second cams 132 that come into contact with the movement restrictors 110J at both the ends of the rotation shaft 120 including the first cam 131, the deformation amount of the elastic layer 171*c* of the fixing roller 171 can be regulated, whereby the traveling performance of the fixing belt 173 is stabilized. In addition, since the contact surfaces between the movement restrictors 110J and the second cams 132 are formed into a predetermined continuous curved shape, the movement restrictors 110*j* can be moved along the curved surfaces of the second cams 132. As a result of this, an end on one side of the pressure roller 172 can be moved forming an arc shape along the outer periphery of the fixing roller 171, whereby the traveling performance of the fixing belt 173 during offset correction can be stabilized. In addition, the contact and separation operation of the pressure roller 172 can be achieved with a single drive source.

Other Embodiments

In the present embodiments, described is the configuration that the belt offset correction device 300 according to the invention is applied to the fixing device 17 of the image forming apparatus 200. However, the invention is not limited to this configuration, and the belt offset correction device 300 according to the invention can also be applied to other units (e.g., the primary transfer belt device 6, and the secondary transfer belt device 10) in the image forming apparatus 200. The invention can also be applied to devices other than the image forming apparatus 200.

In the present embodiments, described is the configuration that the endless belt (the fixing belt 173) is wound around two belt rollers (the fixing roller 171 and the heating roller 174); however, the endless belt may be wound around three or more belt rollers.

The invention is not limited to the embodiments described above, but can be implemented in various other forms. Therefore, such embodiments are merely examples in all respects and should not be interpreted in a limited manner. The scope of the invention shall be indicated by the scope of the claims, and shall not be restricted by the text of the specification. Further, all modifications and changes belonging to the equivalent scope of the claims shall be covered by the scope of the invention.

EXPLANATION OF THE CODE

17, 18, 19 Fixing device
110*a*, 110*b* Pressure lever (pressure member)
110*e*, 110 Fulcrum engaging section
110*h* Guide
110*i* Cam contact portion
110*j* Movement restrictor
110*g* Locking section
111 Cam bearing
112 Cam shaft rotation gear
113 Rotation spindle (rotation fulcrum)
131 First Cam
132 Second Cam
140 Cam shaft (moving member)
141 Cam (moving member)
142 Stopper
171 Fixing roller (belt roller), (opposing member)
172 Pressure roller
174 Heating roller (belt roller)

173 Fixing belt (endless belt)
200 Image forming apparatus
220 Controller
300 Belt offset correction device

What is claimed is:

1. A belt offset correction device comprising:

an endless belt;

a pressure roller that presses an outer side of the endless belt;

an opposing member that is disposed inside the endless belt and sandwiches the endless belt with the pressure roller;

a pair of pressure members that are disposed at both ends of the pressure roller to rotatably support the pressure roller and press the pressure roller against the opposing member; and a moving member that moves one pressure member of the pair of pressure members in a direction intersecting a pressing direction of the pressure roller, wherein each of the pair of pressure members comprises a fulcrum engaging section to be engaged with a rotation fulcrum at one end while being locked to a biasing member at a side opposite to the fulcrum engaging section, wherein at least one of the pressure roller and the opposing member comprises an elastic layer, wherein the moving member controls an offset of the endless belt by moving the one pressure member in a state where deformation of the elastic layer is regulated, wherein each of the pair of pressure members comprises a movement restrictor, and the deformation of the elastic layer is regulated by bringing the movement restrictor into contact with a stopper disposed at a predetermined position away from the rotation fulcrum, wherein an outer circumference of the opposing member comprises a cylindrical shape, and the moving member moves by forming an arc along the outer circumference of the opposing member on one end of the pressure roller.

2. The belt offset correction device according to claim 1, wherein in the one pressure member moved by the moving member, the fulcrum engaging section comprises a guide that guides the one pressure member in a predetermined direction.

3. The belt offset correction device according to claim 2, wherein the one pressure member moved by the moving member is restricted in moving direction by the guide and the movement restrictor of the one pressure member.

4. The belt offset correction device according to claim 3, wherein the one pressure member moved by the moving member moves in an approximately linear direction at the guide while moving in an arc-shaped direction at the movement restrictor of the one pressure member.

5. The belt offset correction device according to claim 1, wherein the movement restrictor and the stopper each comprise a portion of a predetermined curved surface shape that extends along a direction parallel to a longitudinal direction of the opposing member.

6. The belt offset correction device according to claim 1, comprising:

a detector that detects a position of an edge of the endless belt; and a controller that controls a movement amount of the moving member based on a result of detection by the detector.

7. The belt offset correction device according to claim 6, wherein the moving member comprises a cam shaft and a first cam provided to the cam shaft, wherein the one pressure member moved by the moving member comprises a cam contact member that is brought into contact with the first cam, and wherein the controller controls a rotation amount of the cam shaft to control the movement amount of the moving member.

8. A fixing device comprising the belt offset correction device according to claim 1, wherein the endless belt is a fixing belt, and the opposing member is a fixing roller.

9. An image forming apparatus comprising the belt offset correction device according to claim 1.

* * * * *